United States Patent [19]

Brandl

[11] Patent Number: 4,786,112

[45] Date of Patent: Nov. 22, 1988

[54] DRIVING ARRANGEMENT FOR DRIVING THE CUTTING ROLLS OF A DRIFT ADVANCING MACHINE

[75] Inventor: Erich Brandl, Knittelfeld, Austria

[73] Assignee: Voest-Alpine Aktiengesellschaft, Linz, Austria

[21] Appl. No.: 74,060

[22] Filed: Jul. 16, 1987

[30] Foreign Application Priority Data

Jul. 23, 1986 [AT] Austria ..... 1999/86

[51] Int. Cl.[4] ..... E21C 27/24

[52] U.S. Cl. ..... 299/76; 299/89

[58] Field of Search ..... 299/76, 74, 75, 79, 299/89, 54

[56] References Cited

U.S. PATENT DOCUMENTS

| | | | |
|---|---|---|---|
| 2,758,826 | 8/1956 | Paget | 299/76 X |
| 3,157,438 | 11/1964 | Lundquist | 299/89 X |
| 3,614,162 | 10/1971 | Teeter | 299/84 X |
| 3,773,384 | 11/1973 | Anderson | 299/89 X |
| 3,966,257 | 6/1976 | Shah | 299/89 X |
| 4,253,705 | 3/1981 | Le Begue | 299/76 |
| 4,270,803 | 6/1981 | Baum | 299/89 X |

FOREIGN PATENT DOCUMENTS

| | | |
|---|---|---|
| 1470490 | 4/1977 | United Kingdom . |
| 1548206 | 7/1979 | United Kingdom . |

*Primary Examiner*—Jeorme W. Massie
*Assistant Examiner*—David J. Bagnell
*Attorney, Agent, or Firm*—Cushman, Darby & Cushman

[57] ABSTRACT

In a drift advancing machine cutting rolls are rotatably supported on a centrally arranged pivoted arm. Each cutting roll has a separate drive, each of which comprises a drive motor, a drive shaft and a driven shaft being driven via a bevel gear gearing. The drive shaft is a hollow shaft, within which is accommodated the second drive shaft.

8 Claims, 2 Drawing Sheets

DRIVING ARRANGEMENT FOR DRIVING THE CUTTING ROLLS OF A DRIFT ADVANCING MACHINE

BACKGROUND OF THE INVENTION

1. Field of the Invention

The invention refers to a driving arrangement for driving the cutting rolls of a drift advancing machine comprising at least one cutting roll being subdivided in axial direction and being in engagement over at least part of its circumference with the material to be excavated and being movable over the drift face in transverse direction to its axis of rotation.

2. Description of the Prior Art

Such drift advancing machines comprising cutting rolls subdivided in axial direction can, for example, be derived from U.S. Pat. No. 4,253,705. The component parts of such a cutting roll can be shifted one relative to the other in axial direction and to a certain extent, so that a differing width of the cutting roll can be obtained. In these known devices, the cutting rolls are arranged by means of two cantilever arms on a cutting machine, which is, in most cases, movable and may be movable by means of a caterpillar chassis and which may comprise removal conveyor means for transporting away the cut material. From U.S. Pat. No. 3,614,162 there has become known a drift advancing machine comprising cutting means arranged on a swivellable cantilever arm and being driven by a common drive shaft. This shaft is driven by driving motors arranged on the cantilever arm with interposition of reduction gearings.

In such devices the drive motor or drive motors for the rotating drive means for such cutting rolls were coupled one with the other in a force-locking manner, noting that essentially the whole summed-up drive force of the driving motors becomes effective on all component parts of such cutting tools. In practice it is, however, possible that excessive forces become effective on partial areas of the cutting roll during the engagement of such cutting rolls in the rock to be excavated, and in such cases the full driving power becomes effective on that partial areas of the cutting roll, which are subjected to the maximum load. The bearing means and the support means for the cutting roll must, for this reason, be correspondingly designed and it is, as a rule, necessary to use for the purpose of receiving the reactive forces two cantilever arms arranged at a great lateral distance one from the other. The construction and the design of the bearing means must be correspondingly compact and expensive, and such known construction of cantilever arms represent an obstacle for consolidating the drift in proximity of the drift face and also anchoring operations and safety operations at this place.

SUMMARY OF THE INVENTION

The invention now aims at providing a driving arrangement of the initially mentioned type, which has a small space requirement in proximity of the drift face and which provides for a greater stability of the machine and this in particular in combination with a reduced weight. For solving this task, the driving arrangement according to the invention essentially consists in that two separate cutting rolls are rotatably supported at both sides of a swivellable cantilever arm being, in particular, swivellable around a swivelling axis extending in parallel relation to the axis of rotation of the cutting rolls, that both cutting rolls are connected with drive motors via separate drive means and that the drive motors are arranged in the cantilever arm carrying the cutting rolls. On account of both cutting rolls having at disposal separate drive means at both sides of one single swivellable cantilever arm, the reduction gears for both drive means can be designed to correspond to the driving power of one single motor, i.e. half of the driving power, so that the resulting maximum circumferential force at any arbitrary location of a cutting roll is, in each case, only the maximum force of one of the both installed driving motors. There results, beside a reduction of the required size of the gearing and the component parts of the drive means, a substantial higher machine stability and a substantially more facilitated manoeuvrability of a drift advancing machine equipped with the driving arrangement according to the invention, and this on account of the weight reduction within the area of the cutting rolls. On account of each roll half having its own drive means, only substantially reduced reactive forces have, in case of blocking or overload of part of the cutting roll, to be received by the construction of the cantilever arm, so that also the construction of the cantilever arm or boom, respectively, can be correspondingly reduced in weight and be given smaller dimensions. On account of the cantilever arm being centrally arranged and having rotatably supported at its both sides the cutting rolls for rotation around axes intersecting or crossing the axis of the cantilever arm, the required free space is provided at the left-hand side and the right-hand side of the machine for providing the possibility to place consolidating anchors in proximity of the drift face.

The arrangement according to the invention is advantageously designed such that the drive motors are in engagement via drive shafts extending in parallel relation one relative to the other and via bevel gears with driven shafts extending in parallel relation to the axis of rotation of the cutting rolls, which provides the possibility to house within the cantilever arm the drive motors with mutually parallel motor shafts.

For the purpose of making as small as possible the distance of both cutting rolls at the side of the drift face, the construction can advantageously be further developed by coaxially arranging the drive shafts and by designing one drive shaft as a hollow shaft surrounding the other drive shaft.

The distance of the cutting rolls one from the other as well as the weight of the drive shafts can be further reduced by arranging a speed reduction stage within hollow cutting rolls. Such a speed reduction stage arranged within the cutting rolls provides the possibility to particularly advantageously support the cutting rolls on the cantilever arm and to give the driven tooth gears an even smaller size. In this case, the arrangement is advantageously such that the driven shafts being in engagement with the drive shafts via bevel gears are coaxially arranged relative to the axes of the cutting rolls, noting that the driven shafts preferably carry spur gears, which are, via immediate gears stationarily bearingly supported relative to the cantilever arm, in meshing engagement with an internal gearing connected to the cutting rolls in a non-rotatable manner. In this manner, there is provided a reduction gear arranged within the cutting rolls and substantially relieving load from the bevel gears within the cantilever arm.

In a simple manner, the motor shafts of the drive motors may, via spur gears, be in engagement with external gearings of the drive shafts.

A particularly advantageous design for bearingly supporting the cutting rolls on the cantilever arm can be obtained if that component part of the cutting rolls, which carries the internal gearing, is designed as a hollow shaft and is supported in inward radial direction via bearings on the carrier of the intermediate gears and is supported by bearings in radially outward direction on a cutting roll carrier laterally protruding from the cantilever arm in direction of the axis of rotation of the rolls, noting that, preferably for obtaining a correspondingly great distance of the bearings, an internal bearing of the hollow shaft of the cutting rolls is arranged in proximity of the bevel gearing within the cantilever arm and the external bearing is arranged in proximity of the internal gearing of the cutting roll. The internal bearing may, of course, also additionally be provided at a location located at a greater distance from the axis of the cantilever arm on the carrier of the intermediate gears.

The wear of the bevel gearing arranged between the drive shafts and the driven shafts can be reduced by supporting the bevel gears, which are coaxially and non-rotatably connected with the drive shafts, via bearings in a gearing housing rigidly connected to the cantilever arm, so that one can do with bevel gears of particularly small size within the area of the bevel gears and the distance between adjacent cutting rolls can be kept small.

The driven shafts themselves may, in such a construction, advantageously be bearingly supported within the carrier for the intermediate gears, so that there is provided an extremely stable driving arrangement of low-weight construction.

BRIEF DESCRIPTION OF THE DRAWING

In the following, the invention is explained in further detail with reference to an embodiment shown in the drawing.

In the drawing

DETAILED DESCRIPTION OF THE PREFERRED EMBODIMENT

Figure 1:
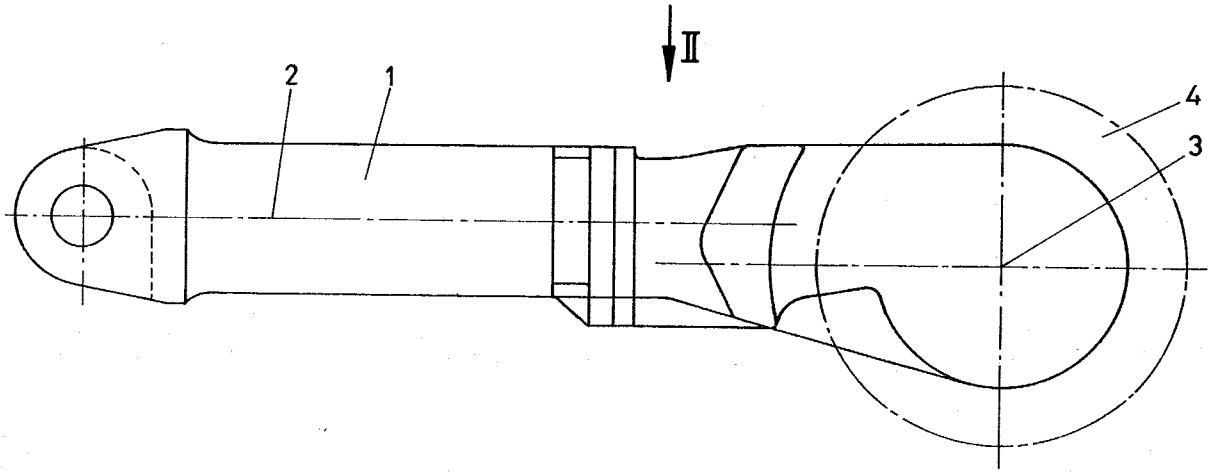
FIG. 1 shows a side elevation of a cantilever arm for cutting rolls.

In FIG. 1, there is shown a cantilever arm 1 containing drive motors. Cutting rolls 4 are arranged at both sides of the cantilever arm along an axis 3 crossing the longitudinal axis 2 of the cantilever arm.

Figure 2:
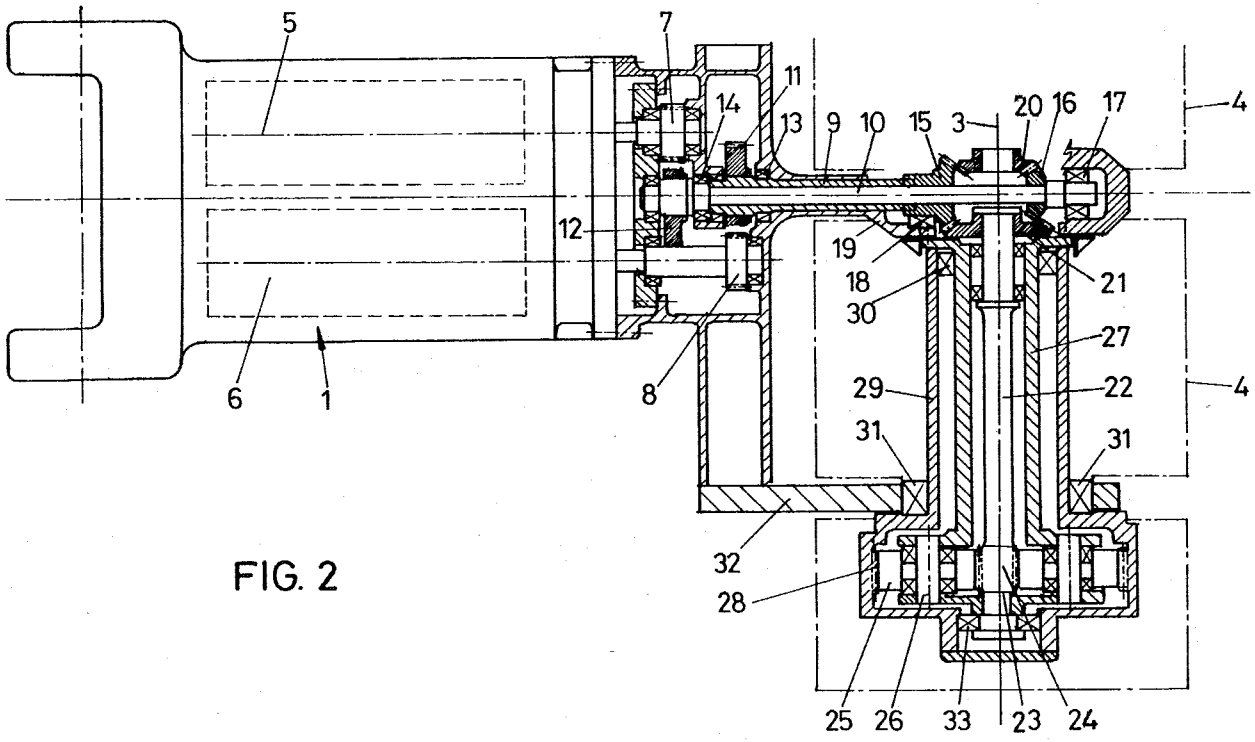
FIG. 2 shows a top plan view in direction of the arrow II of FIG. 1, noting that only one of both cutting rolls is shown in a section for better clarity.

In the top plan view according to FIG. 2 there are schematically indicated two drive motors 5 and 6 being arranged within the cantilever arm 1 and carrying tooth gears 7 and 8 on their motor shafts. The drive shafts are designed as coaxial shafts, noting that there is provided a hollow shaft 9 and a continuous shaft 10 extending through the hollow shaft. The hollow shaft 9 is, via an external gearing 11, in meshing engagement with the driven gear 8 of the motor shaft of the drive motor 6, whereas the inner drive shaft 10 is, via an external gearing 12, in meshing engagement with the driven gear 7 of the motor shaft of the drive motor 5. The bearings for bearingly supporting the coaxial drive shafts 9 and 10 within the cantilever arm 1 are designated by reference numerals 13 and 14.

A bevel gear 15 is non-rotatably connected with the hollow shaft 9 and a bevel gear 16 is non-rotatably connected with the continuous drive shaft 10, noting that these level gears are supported within a gearing housing 19 by means of bearings 17 and 18. The gearing housing 19 is stationarily connected with the cantilever arm 1. The bevel gears 15 and 16 are in meshing engagement with the bevel gears 20 and 21, which are non-rotatably connected with driven shafts 22 intended for driving the cutting rolls 4.

The driven shafts 22, of which only the driven shaft 22 for the right-hand cutting roll 4 is shown in FIG. 2 for better clarity, carry on their free end 23 a spur gear 24 being in meshing engagement with planetary gears 25. The planetary gears 25 are held with their axes 26 within a carrier 27 rigidly connected with the housing 19. The planetary gears 25 are in meshing engagement with an internal gear 28 being non-rotatably connected with the cutting roll 4. That component part of the cutting roll, which carries the internal gear 28, is designed as a hollow shaft 29, noting that this hollow shaft 29 is supported on the carrier 27 via a bearing 30 and on a cutting roll carrier 32 laterally protruding from the cantilever arm via a bearing 31. An additional internal bearing for bearingly supporting the hollow shaft 29 on the carrier 27 may be provided outside of the planetary gears 25 and is designated by the reference numeral 33.

The bevel gears 15 and 16 being non-rotatably coupled to the drive shafts 9 and 10 are of different diameter, because the bevel gear 15 shall exclusively cooperate with the bevel gear 18 of the driven shaft 22 of the right-hand cutting roll 4 and the opposite bevel gear 16 of the drive shaft 10 shall exclusively cooperate with the corresponding driven bevel gear 18 of the opposite cutting roll 4. Sizing is, however, selected such that the ratios remain the same, so that, with the rotating speed of the drive motors 5 and 6 being the same, the same speed of rotation results for the driven shafts 22 for both cutting rolls 4.

What is claimed is:

1. Driving arrangement for driving cutting rolls of a drift advancing machine comprising at least one cutting roll being subdivided in axial direction and being in engagement over at least part of its circumference with the material to be excavated and being movable over the drift face in transverse direction to its axis of rotation, characterized in that two separate cutting rolls are rotatably supported at both sides of a swivellable cantilever arm being, in particular, swivellable around a swivelling axis extending in parallel relation to the axis of rotation of the cutting rolls, that said both cutting rolls are connected with drive motors via separate drive means and that the drive motors are arranged in the cantilever arm carrying the cutting rolls, the drive motors being in meshing engagement via drive shafts extending in parallel relation one relative to the other and via bevel gears with driven shafts extending in parallel relation to the axis of rotation of the cutting rolls, and the drive shafts being coaxially arranged, with one drive shaft being hollow and surrounding the other drive shaft.

2. Driving arrangement as in claim 1 in that the drive motors have motor shafts which are, via spur gears, in meshing engagement with external gearings of the drive shafts.

3. Driving arrangement as claimed in claim 1 characterized in that the driven shafts are in meshing engagement with the drive shafts via bevel gears and are coaxially arranged relative to the axes of rotation of the cutting rolls.

4. Driving arrangement as claimed in claim 3 characterized in that the bevel gears which are coaxially and non-rotatably connected with the drive shafts are supported via bearings within a gearing housing rigidly connected with the cantilever arm.

5. Driving arrangement as claimed in claim 1 characterized in that the driven shafts carry spur gears which are in meshing engagement with an internal gearing non-rotatably connected with the cutting rolls via intermediate gears bearingly supported in stationary relation to the cantilever arm.

6. Driving arrangement as claimed in claim 5 characterized in that a component part of the cutting rolls which carries the internal gearing is a hollow shaft and is supported in radially inward direction via bearings on the carrier of the intermediate gears and is supported, via bearings in radially inward direction on a carrier of the intermediate gears and in radially outward direction on a cutting roll carrier laterally protruding from the cantilever arm in direction of the axis of rotation of the rolls.

7. Driving arrangement as claimed in claim 6, characterized in that an internal bearing of the hollow shaft of the cutting rolls is arranged in proximity of the bevel gear gearing within the cantilever arm and an external bearing is arranged in proximity of the internal gearing of the cutting roll.

8. Driving arrangement as claimed in claim 6 characterized in that the driven shafts of the cutting rolls are bearingly supported within the carrier for the intermediate gears.

* * * * *